US008469666B1

(12) United States Patent
Liang

(10) Patent No.: US 8,469,666 B1
(45) Date of Patent: Jun. 25, 2013

(54) TURBINE BLADE TIP PORTION WITH TRENCHED COOLING HOLES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 13/459,130

(22) Filed: Apr. 28, 2012

Related U.S. Application Data

(63) Continuation of application No. 12/195,484, filed on Aug. 21, 2008, now abandoned.

(51) Int. Cl.
*F01D 5/18* (2006.01)

(52) U.S. Cl.
USPC ..... 416/97 R; 415/115

(58) Field of Classification Search
USPC ..... 416/97 R, 92; 415/115
See application file for complete search history.

(56) References Cited

U.S. PATENT DOCUMENTS

| | | | | |
|---|---|---|---|---|
| 5,192,192 | A * | 3/1993 | Ourhaan | 416/97 R |
| 5,403,158 | A * | 4/1995 | Auxier | 416/97 R |
| 5,660,523 | A * | 8/1997 | Lee | 416/97 R |
| 6,602,052 | B2 * | 8/2003 | Liang | 416/97 R |

* cited by examiner

*Primary Examiner* — Matthew W Such
*Assistant Examiner* — Ali Naraghi
(74) *Attorney, Agent, or Firm* — John Ryznic

(57) ABSTRACT

A turbine blade with a squealer pocket formed by a tip rail extending along the pressure side and suction side of the tip. A row of diffusion trenches are spaced along the pressure side tip rail and the suction side tip rail, each trench formed by side walls and a bottom wall so that the front face and top face of the trench is open. Each trench includes side walls that increase in width in the direction of the tip crown, is connected by a metering hole to discharge cooling air into the trench, are separated from each other and are spaced from near the leading edge to near the trailing edge, and includes a curved inward surface toward the squealer pocket. Two rows of convective cooling holes are spaced adjacent to the pressure side tip rail and the suction side tip rail and open into the squealer pocket.

6 Claims, 4 Drawing Sheets

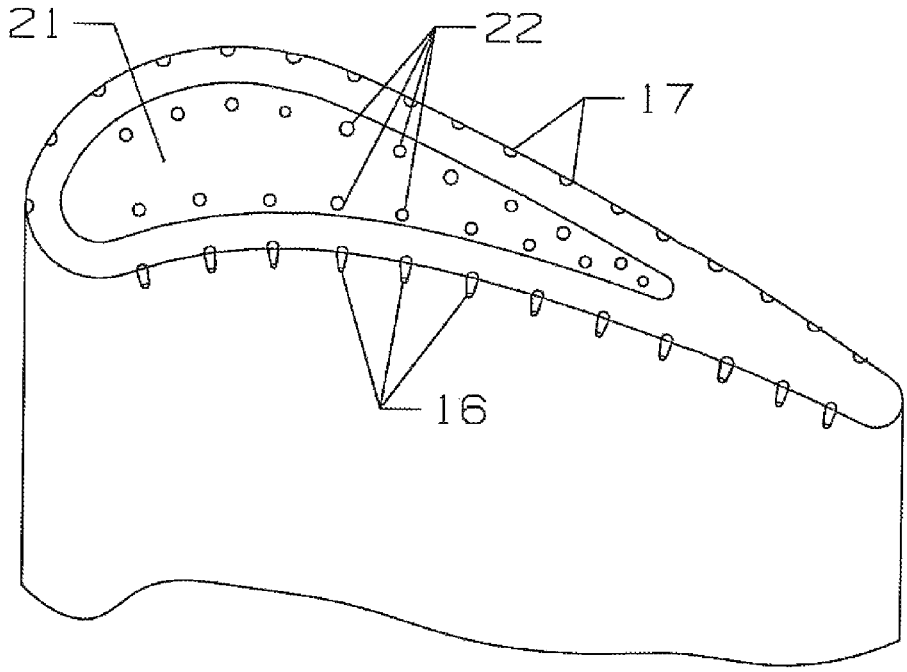
Fig 4
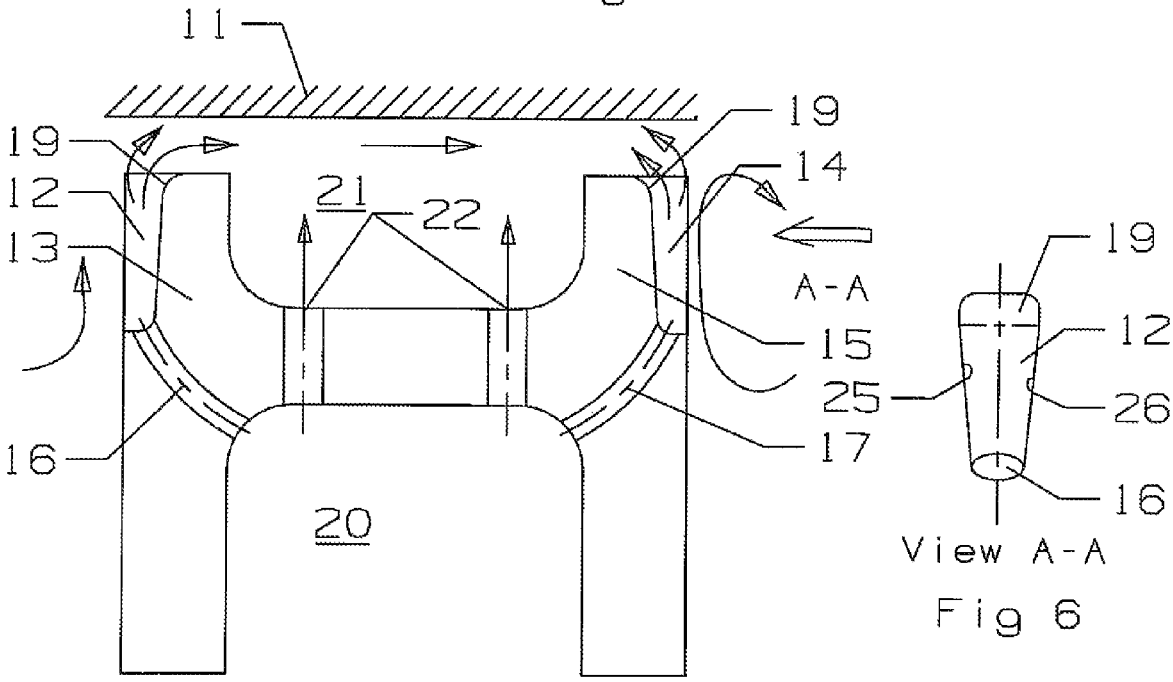
Fig 6
Fig 5

TURBINE BLADE TIP PORTION WITH TRENCHED COOLING HOLES

CROSS-REFERENCE TO RELATED APPLICATIONS

This application is a CONTINUATION of U.S. patent application Ser. No. 12/195,484 filed on Aug. 21, 2008.

FEDERAL RESEARCH STATEMENT

None.

BACKGROUND OF THE INVENTION

1. Field of the Invention

The present invention relates generally to a turbine blade tip seal, and more specifically to a turbine blade tip seal with tip cooling.

2. Description of the Related Art Including Information Disclosed Under 37 CFR 1.97 and 1.98

In a gas turbine engine, especially an industrial gas turbine engine, the turbine includes stages of turbine blades that rotate within a shroud that forms a gap between the rotating blade tip and the stationary shroud. Engine performance and blade tip life can be increased by minimizing the gap so that less hot gas flow leakage occurs.

High temperature turbine blade tip section heat load is a function of the blade tip leakage flow. A high leakage flow will induce a high heat load onto the blade tip section. Thus, blade tip section sealing and cooling have to be addressed as a single problem. A prior art turbine blade tip design is shown in FIGS. 1-3 and includes a squealer tip rail that extends around the perimeter of the airfoil flush with the airfoil wall to form an inner squealer pocket. The main purpose of incorporating the squealer tip in a blade design is to reduce the blade tip leakage and also to provide for improved rubbing capability for the blade. The narrow tip rail provides for a small surface area to rub up against the inner surface of the shroud that forms the tip gap. Thus, less friction and less heat are developed when the tip rubs.

Traditionally, blade tip cooling is accomplished by drilling holes into the upper extremes of the serpentine coolant passages formed within the body of the blade from both the pressure and suction surfaces near the blade tip edge and the top surface of the squealer cavity. In general, film cooling holes are built in along the airfoil pressure side and suction side tip sections and extend from the leading edge to the trailing edge to provide edge cooling for the blade squealer tip. Also, convective cooling holes also built in along the tip rail at the inner portion of the squealer pocket provide additional cooling for the squealer tip rail. Since the blade tip region is subject to severe secondary flow field, this requires a large number of film cooling holes that requires more cooling flow for cooling the blade tip periphery. FIG. 1 shows the prior art squealer tip cooling arrangement and the secondary hot gas flow migration around the blade tip section. FIG. 2 shows a profile view of the pressure side and FIG. 3 shows the suction side each with tip peripheral cooling holes for the prior art turbine blade of FIG. 1.

The blade squealer tip rail is subject to heating from three exposed side: 1) heat load from the airfoil hot gas side surface of the tip rail, 2) heat load from the top portion of the tip rail, and 3) heat load from the back side of the tip rail. Cooling of the squealer tip rail by means of discharge row of film cooling holes along the blade pressure side and suction peripheral and conduction through the base region of the squealer pocket becomes insufficient. This is primarily due to the combination of squealer pocket geometry and the interaction of hot gas secondary flow mixing. The effectiveness induced by the pressure film cooling and tip section convective cooling holes become very limited.

One prior art reference, U.S. Pat. No. 5,476,364 issued to Kildea on Dec. 19, 1995 and entitled TIP SEAL AND ANTI-CONTAMINATION FOR TURBINE BLADES shows a turbine blade with a tip region having a plurality of spaced holes or slots extending chordwise from the leading edge to the trailing edge of the blade tip, the holes being connected to an internal cooling passage, the holes opening into a cavity formed on the outer surface of the tip. The cavities are separate from each other along the tip edge and all are connected to the internal cooling air passage to discharge cooling air out onto the corner of the tip on the pressure side. The cavities in the Kildea patent are not diffusion openings and do not allow for a formation of a layer of film cooling air on the side of the tip that flows over the tip edge as does the trenches in the present invention.

This problem associated with turbine airfoil tip edge cooling can be minimized by incorporation of a new and effective blade tip cooling geometry design of the present invention into the prior art airfoil tip section cooling design.

BRIEF SUMMARY OF THE INVENTION

It is an object of the present invention to provide for a turbine blade with an improved tip cooling than the prior art blade tips.

It is another object of the present invention to provide for a turbine blade with less leakage across the tip gap than in the prior art blade tips.

It is another object of the present invention to provide for a turbine blade with improved film cooling effectiveness for the blade tip than the prior art blade tips.

It is another object of the present invention to provide for a turbine blade with improved life.

It is another object of the present invention to provide for an industrial gas turbine engine with improved performance and increased life over the prior art engines.

The turbine blade includes a tip region that forms a squealer pocket with tip rails on both the pressure side and suction side of the blade. A row of individual cooling trenches extends along the periphery of both the pressure side and suction side tip rail, each trench opening onto the side and top surfaces of the tip rail. Each cooling trench is connected to a curved metering hole to supply cooling air from the internal blade cooling circuit to the respective trench. Each trench includes a bottom side in which the metering hole opens into, and a top side with a curved inside edge on the blade tip crown, and where the trench increases in width from the bottom side to the top side. The cooling trenches extend along the sides of the tip from near the leading edge to near the trailing edge of the blade. The cooling trenches positioned along the blade peripheral edge create an effective method for cooling of the blade tip rail that reduces the blade tip rail metal temperature.

BRIEF DESCRIPTION OF THE SEVERAL VIEWS OF THE DRAWINGS

FIG. 4 shows a profile view of the blade tip cooling design of the present invention from the pressure side.

FIG. 5 shows a cross section view of the blade tip cooling design of the present invention.

FIG. 6 shows a cross section front view of one of the cooling trenches used in the present invention.

DETAILED DESCRIPTION OF THE INVENTION

Figure 1:
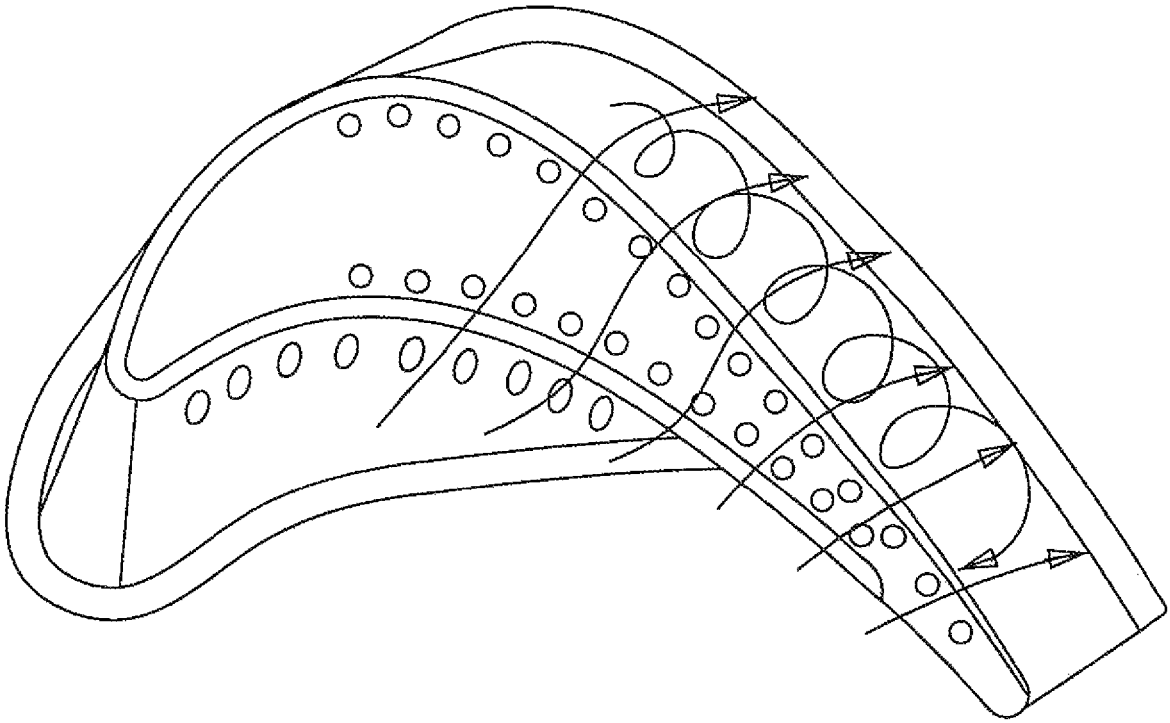
Fig 1 Prior Art
FIG. 1 shows the prior art squealer tip cooling arrangement and the secondary hot gas flow migration around the blade tip section.
Figure 2:
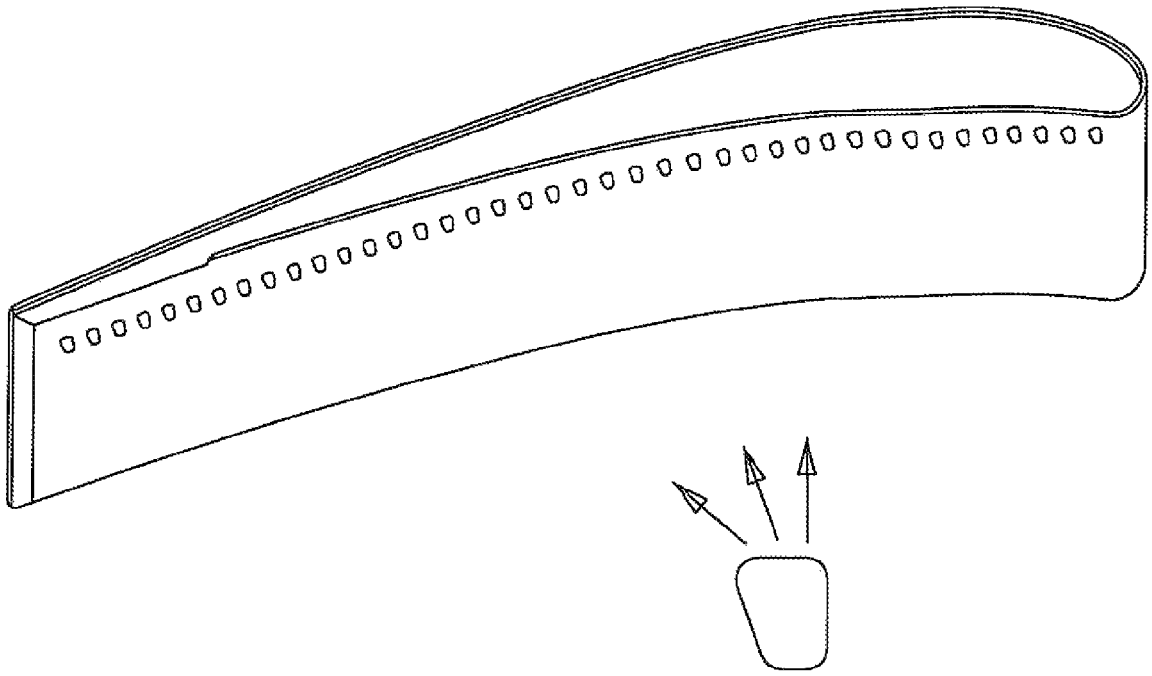
Fig 2 Prior art
FIG. 2 shows a profile view of the pressure side of the prior art blade tip of FIG. 1.
Figure 3:
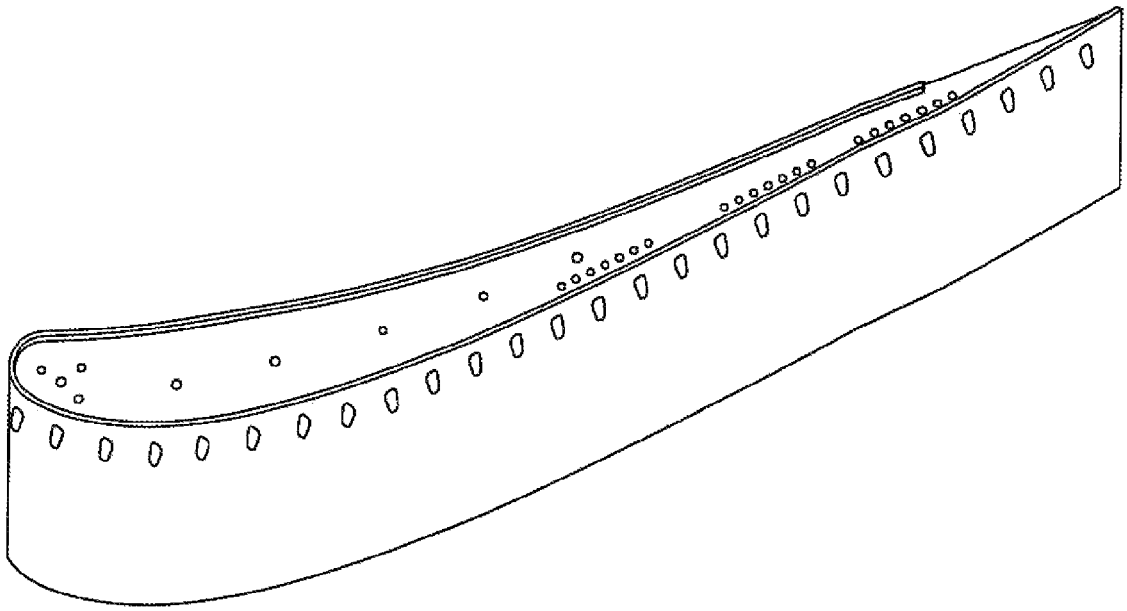
Fig 3 Prior Art
FIG. 3 shows a profile view of the suction side of the prior art blade tip of FIG. 1.

The turbine blade with the tip cooling arrangement of the present invention is shown in FIGS. 4 through 6, where FIG. 4 shows a view of the top and pressure side of the tip in which a squealer pocket is formed by the tip rails that extend around the entire periphery of the tip and a pocket flow. The two rows of trenches are shown on both the pressure side and suction side walls of the tip and open onto the sides and top surface of the tip rail. The trenches extend from near the leading edge to near the trailing edge, being about evenly spaced between adjacent trenches.

FIG. 5 shows a cross section of the blade tip with the tip rails forming the squealer pocket and the pocket floor. A blade outer air seal (BOAS) is formed by the shroud surface 11. One trench 12 is formed on the pressure side tip rail 13 and another trench 14 is formed on the suction side tip rail 15. Each trench includes an inside upper end 19 that curves inward toward the squealer pocket 21 as seen in FIG. 4. Each trench extends about the length of the tip rail height. Each trench is supplied with cooling air through its own metering hole 16 and 17 that is connected to the inner cooling circuit 20 of the blade. The trenches are slightly curved upward. Cooling holes 22 extend through the pocket floor to connect the squealer pocket 21 to the internal cooling air passages 20 of the blade.

The pressure side and suction side film cooling holes (the metering holes 16 and 17) are positioned on the airfoil peripheral tip portion, below the tip peripheral trenches, such that cooling flow exiting the film hole is in the same direction of the vortex flow over the blade tip, from the pressure side wall to the suction side wall. The cooling air discharges from the cooling holes relative to the vortex flow and so that the cooling air is retained within the tip peripheral trenches. Also, the newly created film layer within the tip section trenches will function as a heat sink to transfer the tip section heat loads from the tip crown and the back side of the tip rail. The tip peripheral trenches also increase the tip section cooling side surface area which reduces hot gas convective surface area from the tip crown which results in a reduction of heat load from the tip crown. The trenches also reduce the effective thickness for the blade crown. This increases the effectiveness of backside convection cooling. The trenches also reduce the blade leakage flow by means of pushing the leakage flow toward the blade outer air seal (BOAS) and thus reduce the effective leakage flow area between the blade tip crown and the blade outer air seal (BOAS).

FIG. 6 shows a front view of one of the trenches 12 with the metering hole 16 opening into the bottom and the curved surface 19 on the blade tip crown. The trench includes two side walls 25 and 26. Each trench increases in width in the direction of the air flow through the trench in order to produce a diffusion of the cooling air flow and improve the film layer discharged from the trench over the curved top portion 19. The side walls of each trench can even have a slight curvature on the outer edge of the wall of the blade in which the trench opens onto. Each trench 12 and 14 is open on the front face (against the pressure side wall or the suction side wall and open on the top. Each trench forms a diffusion opening onto the surfaces of the side wall and top or crown of the tip rail.

I claim the following:

1. A turbine blade for use in a gas turbine engine, the blade comprising: a tip region with a squealer pocket formed by pressure side and suction side tip rails; a squealer pocket floor; a plurality of trenches spaced along an edge of the pressure side tip rail and opening onto the pressure side tip rail; each trench being formed by a bottom wall and two side walls; each trench having an open front face on the pressure side wall and an open top face on a tip rail crown; each trench being separated from an adjacent trench; each trench being connected to an internal cooling passage of the blade through a metering hole that opens onto the bottom wall of the trench; each of the metering holes is curved in a direction of a tip squealer pocket; each of the trenches has a curved blade tip crown that is curved toward the inside of the squealer pocket; each of the metering holes opens into the trench at an angle of from around 10 to 30 degrees to the blade wall surface.

2. The turbine blade of claim 1, and further comprising: the plurality of trenches on the pressure side tip rail extends from near a leading edge to near a trailing edge.

3. The turbine blade of claim 2, and further comprising: the plurality of trenches on the pressure side tip rail are evenly spaced.

4. The turbine blade of claim 1, and further comprising: a first row of tip convective cooling holes adjacent to the pressure side tip rail and opening into the pocket; and, a second row of tip convective cooling holes adjacent to the suction side tip rail and opening into the pocket.

5. The turbine blade of claim 1, and further comprising: a second plurality of trenches spaced along an edge of the suction side tip rail.

6. The turbine blade of claim 1, and further comprising: each trench forming a diffusion opening.

* * * * *